US006463917B1

(12) United States Patent
Silver

(10) Patent No.: US 6,463,917 B1
(45) Date of Patent: Oct. 15, 2002

(54) DEVICE FOR IMPROVING COMBUSTION AND ELIMINATING POLLUTANTS FROM INTERNAL COMBUSTION ENGINES

(76) Inventor: Jack Silver, 404 E. Merrimac St., Upland, CA (US) 91784-2038

( * ) Notice: Subject to any disclaimer, the term of this patent is extended or adjusted under 35 U.S.C. 154(b) by 0 days.

(21) Appl. No.: 10/016,218

(22) Filed: Oct. 29, 2001

(51) Int. Cl.[7] ..... F02M 27/00
(52) U.S. Cl. ..... 123/536; 123/539
(58) Field of Search ..... 123/539, 536–537

(56) References Cited

U.S. PATENT DOCUMENTS 4,308,844 A * 1/1982 Persinger ..... 123/539
4,434,771 A * 3/1984 Slimnicki ..... 123/539
4,519,357 A * 5/1985 McAllister ..... 123/539
5,487,874 A * 1/1996 Gibboney, Jr. ..... 123/539
5,692,481 A * 12/1997 Miller ..... 123/539

* cited by examiner

*Primary Examiner*—Marguerite McMahon

(57) ABSTRACT

I have invented a device, which will introduce ozone into the combustion chambers of all internal combustion engines by passing ambient air through the intake manifold and between the electrodes of a high voltage silent discharge, where the oxygen with two atoms is thereby, instantaneously converted to ozone, providing rapid and complete combustion from the added fifty percent more oxygen by weight and volume, providing greater power and efficiency and practically eliminating the need for a catalytic converter to eliminate pollution.

3 Claims, 1 Drawing Sheet

DEVICE FOR IMPROVING COMBUSTION AND ELIMINATING POLLUTANTS FROM INTERNAL COMBUSTION ENGINES

CROSS-REFERENCE TO RELATED APPLICATIONS

Not Applicable

STATEMENT REGARDING FEDERALLY SPONSORED RESEARCH AND DEVELOPMENT

Not Applicable

REFERENCE TO SEQUENCE LISTING, A TABLE OR A COMPUTER PROGRAM LISTING COMPACT DISC APPENDIX

Not Applicable

BACKGROUND OF THE INVENTION

My invention relates to the field of promoting complete combustion in all types of internal combustion engines, the chemistry of combustion, efficiency of combustion, supercharging, eliminating pollution from the exhausts and discarding the catalytic converter.

Supercharging engines without the aid of power-robbing mechanical devices.

Supplying a greatly increased amount of oxygen to the effect that the exhaust is so clean that a catalytic converter is no longer necessary to eliminate polluting substances.

In the prior art, where a carburetor is used, air enters the carburetor, which is designed so that a volume of air draws fuel into the mixture by means of a venturi tube, and provides an approximately accurate 14.7:1 ratio of air to fuel, which includes a large volume of nitrogen with no useful purpose.

In the case of the modern computer controlled engine,, there is, again, the presence of a large volume of useless nitrogen.

In the case of a diesel engine, the same is true as is the case of a jet engine, wherein the injection of fuel into the combustible part of the burning charge is accompanied by a large volume of useless nitrogen.

In my invention, my device introduces ozone $O_3$ into the combustion process, providing fifty percent more oxygen than the $O_2$ by weight and volume that is found in air.

This is accomplished by simply converting the oxygen in the intake air into ozone, instantaneously, and thereby displacing a similar weight and volume of nitrogen and at the same time providing an extremely active oxidizer which is so unstable and ready to combine with fuel that it can easily decompose explosively.

BRIEF SUMMARY OF THE INVENTION

My device converts oxygen to ozone, which then rapidly oxidizes the fuel, practically eliminates unburned hydrocarbons, carbon monoxide and nitrogen oxides and consumes almost all of the oxygen. These results indicate that there is no need for a catalytic converter in the exhaust system of any internal combustion engine that utilizes my invention.

The supercharging effect that is produced lies in the large excess of oxygen with the attendant demand of fuel that results from a signal from the oxygen sensor, where there is one, telling the Electronic Control Unit that a larger amount of fuel is needed.

The elimination of a large percentage of useless nitrogen, removes most of the cause of the toxic nitrogen oxides that form polluting smog in the atmosphere. Since seventy eight percent of air is nitrogen, which does not support combustion it provides no practical purpose in the combustion process.

The compression stroke in diesel engines does not need nitrogen to produce power. Power comes solely from the oxygen present combining with the fuel, which would then burn better, more rapidly and at the appropriate time lessening the explosive rattle of diesel engines and providing great efficiency in the process.

In gasoline engines, as well, nitrogen is wholly unnecessary. Compression strokes without 78% of the intake air being non-combustible nitrogen would, increase efficiency and clean combustion.

In jet engines, where fuel is burned in relatively small combustion chambers and only the bypass air needs a large volume of heated nitrogen to provide thrust, the excess of oxygen in the combustion chambers can be most beneficial and clean burning.

In the two stroke engines, compressing only oxygen and the fuel charge without a mass of nitrogen would improve combustion, of the fuel, as well as, much of the lubricating oil that is mixed with it, providing greater efficiency, power and cleanliness.

BRIEF DESCRIPTION OF THE DRAWING

The drawing depicts an air intake manifold 1, which is sandwiched between two electrodes 2 and 3, and held in place by four insulating posts 4. The source of high voltage 5, is made up of a low voltage primary coil having a negative terminal 6, which is grounded, and a positive terminal 7, which is connected to the vehicle ignition switch 9, or other terminal that is "on" when the ignition switch is "on". Secondary coil 8, delivers high voltage to one electrode 2, and a silent discharge flows across the intake manifold 1, to electrode 3, which is grounded. Item 10 is the air and ozone control valve.

DETAILED DESCRIPTION OF THE INVENTION

Figure 1:
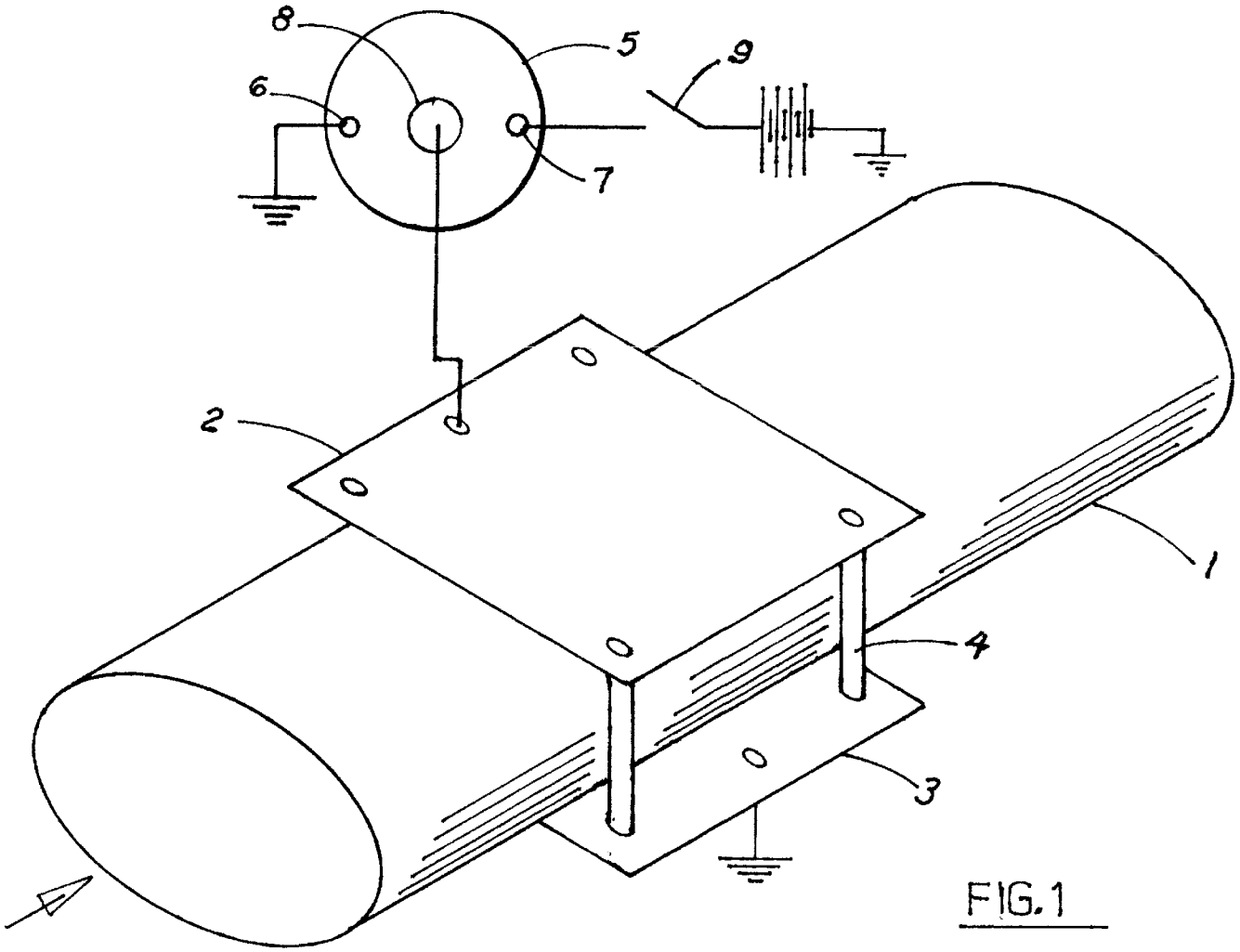

In the preferred embodiment of my invention, the air intake manifold of an internal combustion engine is sandwiched between two electrodes consisting of copper plates. The electrodes are separated by the thickness of the intake manifold and held in place by insulating posts.

The air intake manifold must consist of non-conducting rubber or plastic in the portion where the electrodes are placed. The manifold then becomes a dielectric, which distributes the high voltage charge over the area of the plates without arcing, resulting in the necessary silent discharge.

This silent high voltage discharge converts all the oxygen between the electrodes, instantaneously, into ozone, which then enters the combustion chambers. While an electrical arc will also produce ozone, the noisy discharge will adversely affect other electronics.

No other system utilizes ozone as my system does. My improvement in the combustion process is far superior to that which is generally in use today where the ambient air is used in every internal combustion engine since the dawn of internal combustion engines.

When air enters the intake manifold, not only is the oxygen converted to ozone, the ozone which has three atoms of oxygen in its molecule instead of the two atoms in the oxygen molecule, provides fifty percent more oxygen by weight and volume to effectively displace much of the contaminating nitrogen present.

In my working device, which I constructed and attached to my 1986 Nissan pickup, I cut two rectangular copper plates 2½ inches wide by a length sufficient to reach across the intake manifold with enough extra to have room for the insulating posts. I placed the plates in contact with the rubber portion of the manifold and held them in place with insulating posts at each corner.

I mounted an off-the-shelf ignition coil of about 40,000 volts to the frame of my pickup and connected the wires as shown in the drawing. The spacing between the plates at this voltage, is not critical and the silent discharge continues as long as the vehicle ignition switch is "on".

When I started the engine and drove away, I was astounded and amazed by the power and acceleration that suddenly developed. Obviously, the introduction of ozone produced so much excess oxygen, that when the ECU was triggered by the oxygen sensor to inject a greater quantity of fuel in order to create a stoichiometric mix it, in effect, supercharged the engine, with a minimum of contaminating nitrogen in the exhaust On Oct. 22, 2001, I had my pickup smog checked on a dynamometer. The resulting graph showed zero emissions of unburned hydrocarbons, carbon monoxide and oxygen, with only minimal emissions of nitrogen oxides. After 20 seconds from the start of the test, the graph printed shows continuous flat lines of the above parameters. A steady volume of carbon dioxide was formed.

Installing a butterfly valve in the intake manifold of ECU controlled engines would reduce the ozone and fuel requirements for fuel economy.

I claim:

1. A simplified ozone production system having two ozone generating electrodes placed externally to the air intake manifold such that the air intake manifold is sandwiched between the two electrodes so as to send a silent high voltage discharge to pass between said electrodes and across the incoming air, thereby converting oxygen in said intake air into ozone.

2. The ozone production system according to claim 1 and wherein said silent high voltage discharge is provided by an automotive ignition coil of 40,000 to 60,000 volts.

3. The ozone production system according to claim 1 and wherein ozone production and air flow is unlimited, uncontrolled and unrestricted.

* * * * *